US010590942B2

(12) United States Patent
Farnsworth

(10) Patent No.: US 10,590,942 B2
(45) Date of Patent: Mar. 17, 2020

(54) INTERPOLATION OF HOMOTOPIC OPERATING STATES

(71) Applicant: Toyota Motor Engineering & Manufacturing North America, Inc., Erlanger, KY (US)

(72) Inventor: Jared Farnsworth, Roseville, CA (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 124 days.

(21) Appl. No.: 15/836,701

(22) Filed: Dec. 8, 2017

(65) Prior Publication Data

US 2019/0178256 A1 Jun. 13, 2019

(51) Int. Cl.
*F04D 27/02* (2006.01)
*F04D 27/00* (2006.01)
(Continued)

(52) U.S. Cl.
CPC ..... *F04D 27/02* (2013.01); *F02B 33/40* (2013.01); *F04D 25/06* (2013.01); *F04D 27/001* (2013.01);
(Continued)

(58) Field of Classification Search
CPC ..... F04D 27/02; F02B 33/40
See application file for complete search history.

(56) References Cited

U.S. PATENT DOCUMENTS 6,442,455 B1 8/2002 Kotre et al.
6,480,767 B2 11/2002 Yamaguchi et al.
(Continued)

FOREIGN PATENT DOCUMENTS

CN 202065044 12/2011
CN 202930480 8/2013
(Continued)

OTHER PUBLICATIONS

Pablo Guinta et al.; "*Calculation of Multiplicity of Steady States in a Catalyst Pellet by Homotopic Continuation Method*"; AIChE Journal; (40 pages).

*Primary Examiner* — Rocio Del Mar Perez-Velez
*Assistant Examiner* — Hawa Z Dirie
(74) *Attorney, Agent, or Firm* — Snell & Wilmer LLP

(57) ABSTRACT

A system for real-time modeling includes a compressor designed to operate at a compressor speed, a compressor flow rate, and a compressor pressure ratio. The system also includes a memory designed to store an operating condition matrix that plots multiple compressor pressure ratios to each of a plurality of compressor speeds, and a related operating state matrix that plots multiple compressor flow rates to each of the plurality of compressor speeds. The system also includes a compressor controller to determine a target compressor speed and a target compressor pressure ratio, and to identify a target location in the operating condition matrix based on the target compressor speed and the target compressor pressure ratio. The compressor controller also determines a target compressor flow rate by interpolating values in the operating state matrix based on the target location, and to control the compressor based on the target compressor flow rate.

16 Claims, 9 Drawing Sheets

(51) Int. Cl.

| | |
|---|---|
| ***F02B 33/40*** | (2006.01) |
| ***F04D 25/06*** | (2006.01) |
| ***F02B 37/12*** | (2006.01) |
| ***F04D 17/10*** | (2006.01) |

(52) U.S. Cl.
CPC ..... *F02B 2037/125* (2013.01); *F04D 17/10* (2013.01)

(56) References Cited

U.S. PATENT DOCUMENTS

| | | | |
|---|---|---|---|
| 6,635,374 | B1 | 10/2003 | Aramaki |
| 6,847,188 | B2 | 1/2005 | Keskula et al. |
| 6,924,050 | B2 | 8/2005 | Lahiff |
| 6,936,359 | B2 | 8/2005 | Kobayashi et al. |
| 7,117,078 | B1 | 10/2006 | Gangopadhyay |
| 7,124,040 | B2 | 10/2006 | Engelhardt et al. |
| 7,141,326 | B2 | 11/2006 | Kobayashi et al. |
| 7,247,401 | B2 | 7/2007 | Aberle et al. |
| 7,348,082 | B2 | 3/2008 | Kolodziej |
| 7,353,900 | B2 | 4/2008 | Abe et al. |
| 7,608,011 | B2 | 10/2009 | Grabowski et al. |
| 7,612,532 | B2 | 11/2009 | Verbrugge |
| 7,682,717 | B2 | 3/2010 | Ueda et al. |
| 7,682,719 | B2 | 3/2010 | Lienkamp et al. |
| 7,687,164 | B2 | 3/2010 | Frost et al. |
| 7,845,187 | B2 | 12/2010 | Patel et al. |
| 7,919,211 | B2 | 4/2011 | Nonobe et al. |
| 8,044,534 | B2 | 10/2011 | Kojima et al. |
| 8,141,356 | B2 | 3/2012 | Leone et al. |
| 8,153,321 | B2 | 4/2012 | Katano |
| 8,215,428 | B2 | 7/2012 | Lee et al. |
| 8,293,413 | B2 | 10/2012 | Bono |
| 8,342,275 | B2 | 1/2013 | Ojima et al. |
| 8,394,542 | B2 | 3/2013 | Elwart et al. |
| 8,486,574 | B2 | 7/2013 | Jenings |
| 8,498,766 | B2 | 7/2013 | Takahashi et al. |
| 8,561,453 | B2 | 10/2013 | Hobmeyr et al. |
| 8,568,935 | B2 | 10/2013 | Arthur et al. |
| 8,673,515 | B2 | 3/2014 | Harris et al. |
| 8,684,117 | B2 | 4/2014 | Ptacek et al. |
| 8,691,456 | B2 | 4/2014 | Choe et al. |
| 8,715,875 | B2 | 5/2014 | Chan et al. |
| 8,722,263 | B2 | 5/2014 | Cai et al. |
| 8,754,392 | B2 | 6/2014 | Caimi et al. |
| 8,757,223 | B2 | 6/2014 | Uemura |
| 8,796,984 | B2 | 8/2014 | Yoshida et al. |
| 8,846,262 | B2 | 9/2014 | Mussro et al. |
| 8,920,995 | B2 | 12/2014 | Lebzelter et al. |
| 8,935,029 | B2 | 1/2015 | Sabrie et al. |
| 8,951,685 | B2 | 2/2015 | Aso et al. |
| 8,956,778 | B2 | 2/2015 | Zhang et al. |
| 8,962,208 | B2 | 2/2015 | Mussro et al. |
| 8,986,899 | B2 | 3/2015 | Harris et al. |
| 8,997,771 | B2 | 4/2015 | Lee et al. |
| 9,002,568 | B2 | 4/2015 | Datta et al. |
| 9,005,785 | B2 | 4/2015 | Alp et al. |
| 9,021,824 | B2 | 5/2015 | Koo et al. |
| 9,099,701 | B2 | 8/2015 | Maslyn et al. |
| 9,187,009 | B2 | 11/2015 | Jeon et al. |
| 9,242,532 | B2 | 1/2016 | Kim et al. |
| 9,242,573 | B2 | 1/2016 | Lee et al. |
| 9,281,532 | B2 | 3/2016 | Lebzelter et al. |
| 9,281,533 | B2 | 3/2016 | Ozawa et al. |
| 9,312,549 | B2 | 4/2016 | Tachibana et al. |
| 9,318,778 | B2 | 4/2016 | Wahlstrom et al. |
| 9,358,900 | B2 | 6/2016 | Wake et al. |
| 9,437,884 | B2 | 9/2016 | Kolodziej |
| 9,457,640 | B2 | 10/2016 | Ikeya |
| 9,472,818 | B2 | 10/2016 | Kilmer |
| 9,527,404 | B2 | 12/2016 | Gauthier et al. |
| 9,531,019 | B2 | 12/2016 | Jeon |
| 9,590,259 | B2 | 3/2017 | Toida |
| 9,614,236 | B2 | 4/2017 | Yu et al. |
| 9,620,796 | B2 | 4/2017 | Tomita et al. |
| 9,620,799 | B2 | 4/2017 | Igarashi et al. |
| 9,643,517 | B2 | 5/2017 | Watanabe et al. |
| 2003/0105562 | A1 | 6/2003 | Hsiao et al. |
| 2004/0018399 | A1 | 1/2004 | Jung |
| 2006/0134472 | A1 | 6/2006 | Bach et al. |
| 2008/0286622 | A1 | 11/2008 | Shaw et al. |
| 2009/0050082 | A1 | 2/2009 | Iwasaki |
| 2009/0071439 | A1* | 3/2009 | Shiraishi ..... F02D 31/002 123/403 |
| 2009/0325010 | A1* | 12/2009 | Kirklin ..... H01M 8/04089 429/413 |
| 2011/0214930 | A1 | 9/2011 | Betts et al. |
| 2012/0129059 | A1 | 5/2012 | Ohashi |
| 2013/0074492 | A1* | 3/2013 | Chi ..... F02B 37/18 60/602 |
| 2014/0000859 | A1 | 1/2014 | Abihana |
| 2014/0000862 | A1 | 1/2014 | Abihana et al. |
| 2014/0103128 | A1 | 4/2014 | Patel et al. |
| 2014/0120440 | A1 | 5/2014 | Nolan et al. |
| 2014/0120445 | A1* | 5/2014 | Mussro ..... H01M 8/04992 429/444 |
| 2014/0335432 | A1 | 11/2014 | Sinha et al. |
| 2014/0342253 | A1 | 11/2014 | Lee et al. |
| 2014/0370412 | A1 | 12/2014 | Sumser et al. |
| 2015/0047344 | A1* | 2/2015 | Shao ..... F02D 41/0007 60/602 |
| 2015/0188157 | A1 | 7/2015 | Na et al. |
| 2016/0006049 | A1 | 1/2016 | Kwon et al. |
| 2016/0137096 | A1 | 5/2016 | Oda et al. |
| 2016/0141645 | A1 | 5/2016 | Yamada et al. |
| 2016/0141661 | A1 | 5/2016 | Kim et al. |
| 2016/0141666 | A1 | 5/2016 | Shim et al. |
| 2016/0153367 | A1 | 6/2016 | Yoon |
| 2016/0172696 | A1 | 6/2016 | Milacic et al. |
| 2016/0211536 | A1 | 7/2016 | Kwon et al. |
| 2016/0336607 | A1 | 11/2016 | Lee et al. |
| 2016/0359181 | A1 | 12/2016 | Lee |
| 2016/0372768 | A1 | 12/2016 | Proctor et al. |
| 2017/0012310 | A1 | 1/2017 | Han et al. |
| 2017/0047603 | A1 | 2/2017 | Kazuno |
| 2017/0092972 | A1 | 3/2017 | Pence |
| 2017/0162885 | A1 | 6/2017 | Kim |
| 2017/0179511 | A1 | 6/2017 | Jung et al. |

FOREIGN PATENT DOCUMENTS

| | | |
|---|---|---|
| CN | 105895941 | 8/2016 |
| GB | 2533015 | 6/2016 |
| JP | 2005347008 | 12/2005 |
| KR | 100863649 | 6/2007 |
| WO | WO2005078257 | 8/2005 |
| WO | WO2013073457 | 5/2013 |

* cited by examiner

| RPM | LOC 1 | LOC 2 | LOC 3 | LOC 4 | LOC 5 |
|---|---|---|---|---|---|
| 1500 | 5 | 5 | 4.5 | 4 | 3.5 |
| 1400 | 4.5 | 4.5 | 4 | 3.5 | 3 |
| 1300 | 4 | 4 | 3.5 | 3 | 2.5 |

| | | | | | |
|---|---|---|---|---|---|
| 1450 | 4.75 | 4.75 | 4.25 | 3.75 | 3.25 |

| RPM | LOC 1 | LOC 2 | LOC 3 | LOC 4 | LOC 5 |
|---|---|---|---|---|---|
| 1500 | 2000 | 2500 | 3000 | 3500 | 4000 |
| 1400 | 2500 | 2750 | 3000 | 3250 | 3500 |
| 1300 | 2600 | 2800 | 3000 | 3200 | 3400 |

| | | | | | |
|---|---|---|---|---|---|
| 1450 | 2250 | 2625 | 3000 | 3375 | 3750 |

INTERPOLATION OF HOMOTOPIC OPERATING STATES

BACKGROUND

1. Field

The present disclosure relates to systems and methods for controlling a compressor for use in a fuel cell circuit of a vehicle and, more particularly, to systems and methods for creating a real-time model of the compressor and controlling the compressor using the real-time model.

2. Description of the Related Art

Fuel cell vehicles are becoming more and more popular. Fuel cells may receive air and hydrogen and may facilitate a reaction between the air and hydrogen to generate electricity. The electricity may be stored in a battery and/or received by a motor generator of the vehicle which converts the electrical energy into mechanical power for propelling the vehicle.

Fuel cell vehicles typically include a fuel cell circuit that provides the air to the fuel cells. The fuel cell circuit may include a compressor that compresses the air and directs the pressurized air to the fuel cells. Due to the complexity of the fuel cell circuit, an electronic control unit (ECU) of the vehicle may control the fuel cell circuit using a real-time model.

Compressors may be relatively difficult to model due to the interaction of multiple coupled states of the compressor. In particular, the multiple coupled states may include a compressor speed, a compressor flow rate, and a compressor pressure ratio corresponding to a ratio of a pressure at an outlet of the compressor to a pressure at an inlet of the compressor. Because the states are coupled, a change in one of the states results in a change in the remaining states. Because of this coupling, real-time modeling of a compressor is relatively difficult.

Accordingly, there is a need in the art for systems and methods for creating a real-time model of a compressor, and controlling the compressor using the real-time model.

SUMMARY

Described herein is a system for real-time controller modeling. The system includes a compressor having an inlet and an outlet and designed to operate at a compressor speed, a compressor flow rate corresponding to a flow of fluid through the compressor, and a compressor pressure ratio corresponding to a ratio of an inlet pressure at the inlet to an outlet pressure at the outlet. The system also includes a memory designed to store an operating condition matrix that plots multiple compressor pressure ratios to each of a plurality of compressor speeds, and an operating state matrix that plots multiple compressor flow rates to each of the plurality of compressor speeds, the operating condition matrix being related to the operating state matrix such that a first compressor pressure ratio at a first location of the operating condition matrix corresponds to a first compressor flow rate at a corresponding location of the operating state matrix. The system also includes a compressor controller coupled to the compressor and the memory. The compressor controller is designed to determine a current or target compressor speed and a current or target compressor pressure ratio. The compressor controller is also designed to identify a current or target location in the operating condition matrix based on the current or target compressor speed and the current or target compressor pressure ratio. The compressor controller is also designed to determine a current or target compressor flow rate by interpolating values in the operating state matrix based on the current or target location. The compressor controller is also designed to control the compressor based on the current or target compressor flow rate.

Also described is a method for real-time modeling of a compressor. The method includes storing, in a memory, an operating condition matrix that plots multiple compressor pressure ratios to each of a plurality of compressor speeds. The method also includes storing, in the memory, an operating state matrix that plots multiple compressor flow rates to each of the plurality of compressor speeds, the operating condition matrix being related to the operating state matrix such that a first compressor pressure ratio at a first location of the operating condition matrix corresponds to a first compressor flow rate at a corresponding location of the operating state matrix. The method also includes determining, by a compressor controller, a current or target compressor speed and a current or target compressor pressure ratio. The method also includes identifying, by the compressor controller, a current or target location in the operating condition matrix based on the current or target compressor speed and the current or target compressor pressure ratio. The method also includes determining, by the compressor controller, a current or target compressor flow rate by interpolating values in the operating state matrix based on the current or target location. The method also includes controlling, by the compressor controller, the compressor based on the current or target compressor flow rate.

Also described is a method for real-time modeling of a compressor. The method includes obtaining, by a model controller, test data including combinations of compressor speeds, compressor pressure ratios, and compressor flow rates. The method also includes generating, by the model controller, an operating condition matrix that plots multiple compressor pressure ratios to each of a plurality of compressor speeds based on the test data. The method also includes generating, by the model controller, an operating state matrix that plots multiple compressor flow rates to each of the plurality of compressor speeds based on the test data. The method also includes providing the operating condition matrix and the operating state matrix to a compressor controller as a model of the compressor such that the compressor controller can control the compressor based on the model.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

The present disclosure describes systems and methods for creating a real-time model of a compressor, and controlling the compressor using the real-time model. The systems provide several benefits and advantages, for example, such as taking advantage of the fact that the multiple states of the compressor are homotopic. By recognizing the fact that the compressor states are homotopic, the systems advantageously create a real-time model that includes a relatively small amount of data, which results in significant memory savings. The systems can advantageously interpolate between the data points of the model due to the fact that the states are homotopic, which allows the model to be performed using relatively little processing power. The homotopic relationship between the states results in interpolation between states being linear, which allows the system to control the compressor with relatively high accuracy.

An exemplary system includes a memory, a compressor controller, and a compressor. The memory may store an operating condition matrix that includes multiple pressure ratios for each of a plurality of compressor speeds. The memory may also store an operating state matrix that includes multiple compressor flow rates for each of the plurality of compressor speeds. The operating condition matrix corresponds to the operating state matrix such that a location in the operating state matrix corresponds to the same location in the operating condition matrix. The compressor controller may receive a target compressor pressure ratio and a target compressor speed and may wish to determine a target compressor flow rate. The compressor controller may then find a location in the operating condition matrix that corresponds to the target pressure ratio and the target compressor speed. The compressor controller may then identify the corresponding location in the operating state matrix. The compressor controller may then interpolate between the values in the operating state matrix that are adjacent to the corresponding location, the interpolation resulting in the target compressor flow rate.

Figure 1:
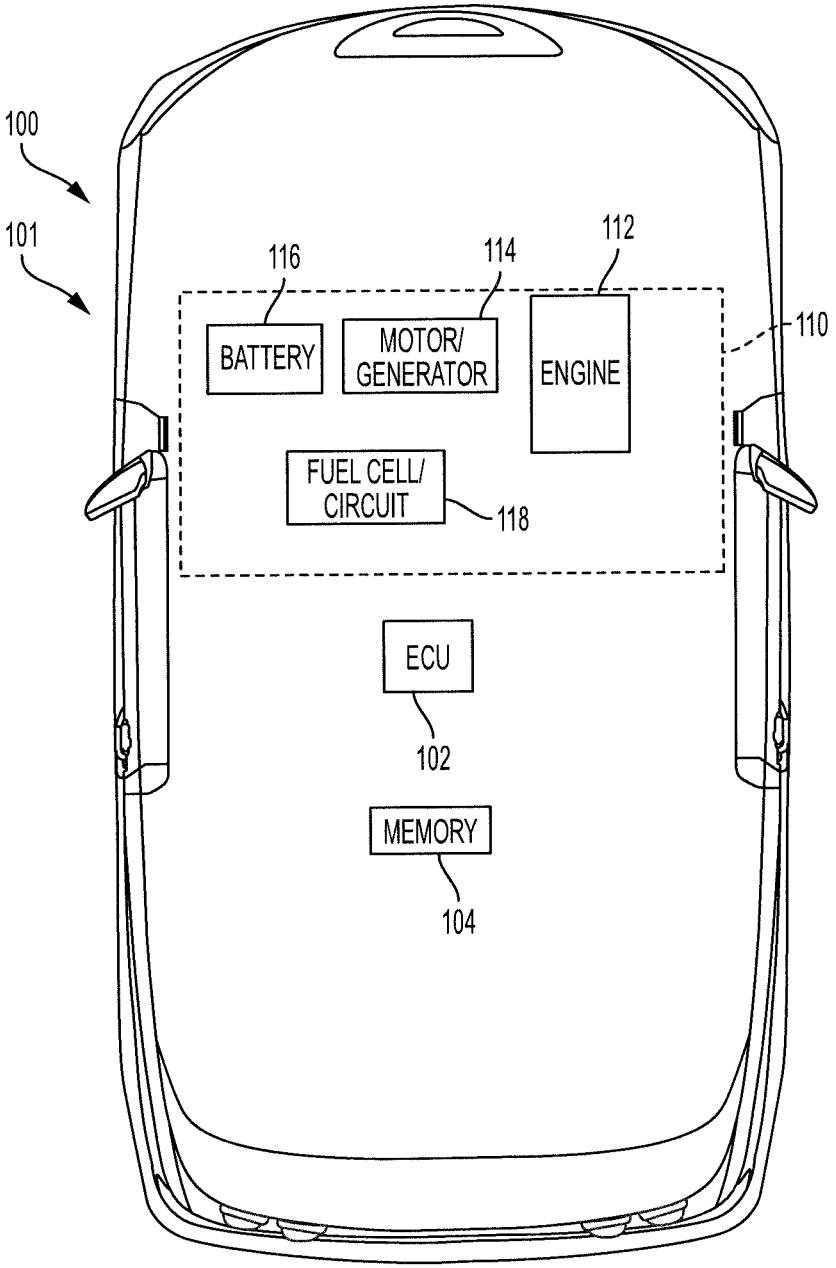
FIG. 1 is a block diagram illustrating various components of a vehicle having a fuel cell circuit capable of generating electricity based on a chemical reaction according to an embodiment of the present invention.

Turning to FIG. 1, a vehicle 100 includes components of a system 101 for providing gas, such as air, to fuel cells. In particular, the vehicle 100 and system 101 include an ECU 102 and a memory 104. The vehicle 100 further includes a power source 110 which may include at least one of an engine 112, a motor-generator 114, a battery 116, or a fuel cell circuit 118. The fuel cell circuit 118 may be a part of the system 101.

The ECU 102 may be coupled to each of the components of the vehicle 100 and may include one or more processors or controllers, which may be specifically designed for automotive systems. The functions of the ECU 102 may be implemented in a single ECU or in multiple ECUs. The ECU 102 may receive data from components of the vehicle 100, may make determinations based on the received data, and may control the operation of components based on the determinations.

In some embodiments, the vehicle 100 may be fully autonomous or semi-autonomous. In that regard, the ECU 102 may control various aspects of the vehicle 100 (such as steering, braking, accelerating, or the like) to maneuver the vehicle 100 from a starting location to a destination.

The memory 104 may include any non-transitory memory known in the art. In that regard, the memory 104 may store machine-readable instructions usable by the ECU 102 and may store other data as requested by the ECU 102 or programmed by a vehicle manufacturer or operator. The memory 104 may store a model of components of the fuel cell circuit 118. The model may include equations or matrices usable to estimate various parameters of the components of the fuel cell circuit 118.

The engine 112 may convert a fuel into mechanical power. In that regard, the engine 112 may be a gasoline engine, a diesel engine, or the like.

The battery 116 may store electrical energy. In some embodiments, the battery 116 may include any one or more energy storage device including a battery, a fly-wheel, a super-capacitor, a thermal storage device, or the like.

The fuel cell circuit 118 may include a plurality of fuel cells that facilitate a chemical reaction to generate electrical energy. For example, the fuel cells may receive hydrogen and oxygen, facilitate a reaction between the hydrogen and oxygen, and output electricity in response to the reaction. In that regard, the electrical energy generated by the fuel cell circuit 118 may be stored in the battery 116. In some embodiments, the vehicle 100 may include multiple fuel cell circuits including the fuel cell circuit 118.

The motor-generator 114 may convert the electrical energy stored in the battery (or electrical energy received directly from the fuel cell circuit 118) into mechanical power usable to propel the vehicle 100. The motor-generator 114 may further convert mechanical power received from the engine 112 or wheels of the vehicle 100 into electricity, which may be stored in the battery 116 as energy and/or used by other components of the vehicle 100. In some embodiments, the motor-generator 114 may also or instead include a turbine or other device capable of generating thrust.

Figure 2:
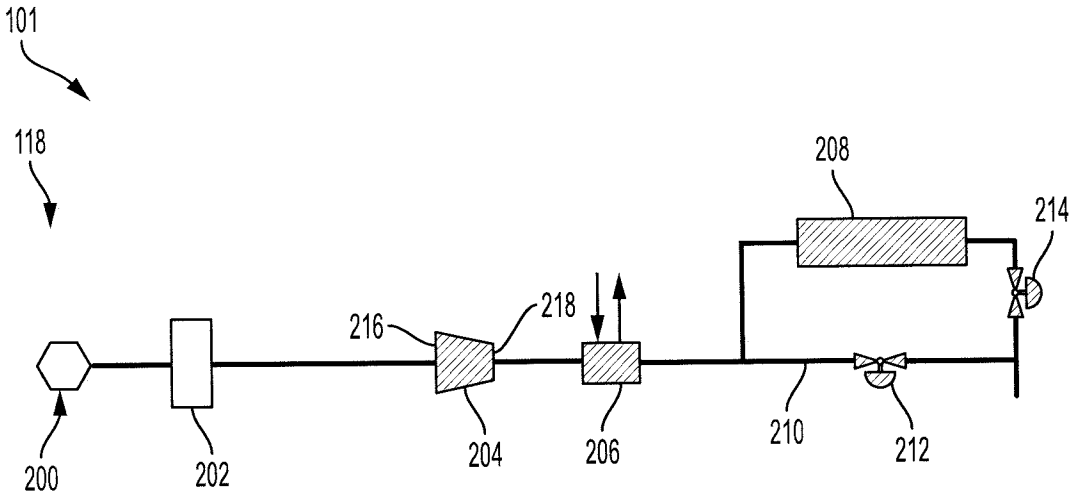
FIG. 2 is a block diagram illustrating various features of the fuel cell circuit of FIG. 1 according to an embodiment of the present invention.

Turning now to FIG. 2, additional details of the fuel cell circuit 118 are illustrated. In particular, the fuel cell circuit 118 includes an air intake 200, an air cleaner 202, a compressor 204, an intercooler 206, a fuel cell stack 208, a bypass branch 210, a bypass valve 212 positioned along the bypass branch 210, and a restriction valve 214.

The air intake 200 may receive air from an ambient environment, such as outside of the vehicle 100 of FIG. 1.

In some embodiments, the air intake 200 may include a filter for filtering debris from the received air. The air cleaner 202 may include a filter or other device capable of removing debris and other impurities from the air received from the air intake 200.

The compressor 204 may be a turbo compressor or other compressor capable of pressurizing air. In that regard, the compressor 204 may draw air from the cleaner 202 and may output pressurized air.

The intercooler 206 may receive the air from the compressor 204 and may also receive a fluid, such as a coolant. The intercooler 206 may transfer heat from the air to the coolant, or may transfer heat from the coolant to the air. In that regard, the intercooler 206 may adjust a temperature of the air flowing through the fuel cell circuit 118.

The fuel cell stack 208 may include a plurality of fuel cells. The fuel cells may receive hydrogen along with the air from the intercooler 206. The fuel cells may facilitate a chemical reaction between the oxygen in the air and the hydrogen, which may generate electricity.

The air from the intercooler 206 may be split such that some of the air flows through the fuel cell stack 208 and some of the air flows through the bypass branch 210. In that regard, the air flowing through the bypass branch 210 fails to flow through the fuel cell stack 208. The bypass valve 212 may have an adjustable valve position controllable to adjust an amount of airflow through the bypass branch 210.

The restriction valve 214 may likewise have an adjustable valve position controllable to adjust a pressure of the air within the fuel cell stack 208.

Referring to FIGS. 1 and 2, the memory 104 may include a model of the compressor 204 such that the ECU 102 may control the compressor 204 based on the model. In particular, the compressor 204 may have a plurality of coupled states including a compressor flow rate corresponding to a rate of the air flowing through the compressor 204. The coupled states may further include a compressor speed corresponding to an angular or rotational speed of the compressor 204. The coupled states may also include a pressure ratio corresponding to a pressure of the air at an outlet 218 of the compressor 204 to a pressure of the air at an inlet 216 of the compressor 204.

The compressor flow rate, the compressor speed, and the compressor pressure ratio may be referred to as coupled states because a change in one of the states results in a change to the remaining states. For example, a change in pressure ratio across the compressor 204 may result in a change in compressor speed and a change in compressor flow rate.

Figure 3:
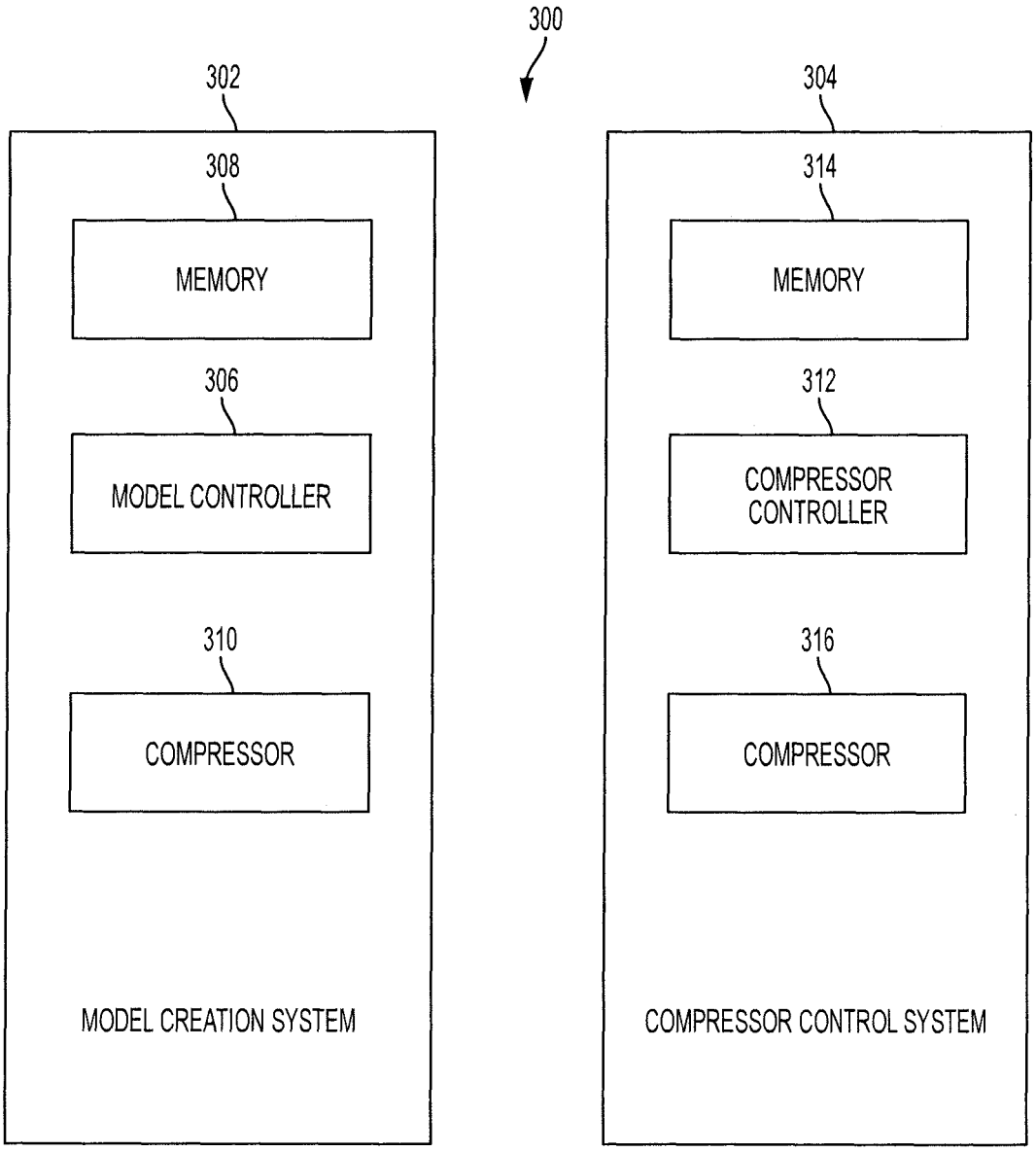
FIG. 3 is a block diagram illustrating a system for creating and using a real-time model of a compressor according to an embodiment of the present invention.

Turning now to FIG. 3, a system 300 for creating a model of a compressor and controlling a compressor based on the model is shown. In particular, the system 300 includes a model creation system 302 and a compressor control system 304.

The model creation system 302 may include a model controller 306, a memory 308, and a compressor or model of a compressor 310. The model controller 306 may receive test data from the compressor or the model of the compressor 310. The model controller 306 may then create a real-time model of the compressor which may be used to control the compressor in real-time. The real-time model of the compressor may then be stored in the memory 308. The real-time model may differ from the model of the compressor 310 because the model of the compressor 310 may be incapable of running in real-time.

The compressor control system 304 includes a compressor controller 312, a memory 314, and a physical compressor 316. In various embodiments, the compressor controller 312 may be the ECU 102 of FIG. 1, the memory 314 may be the memory 104 of FIG. 1, and the compressor 316 may be the compressor 204 of FIG. 2. The model controller 306 may provide, via an output device or input/output unit, the real-time model of the compressor to the compressor controller 312. The compressor controller 312 may then store the real-time model in the memory 314. The compressor controller 312 may then control the compressor 316 in real-time based on the real-time model.

For example, the compressor controller 312 may determine or receive a desired compressor speed and a desired compressor pressure ratio. The compressor controller 312 may then use the real-time model to identify a desired compressor flow rate, and may then control the compressor 316 to have the desired compressor flow rate.

Figure 4:
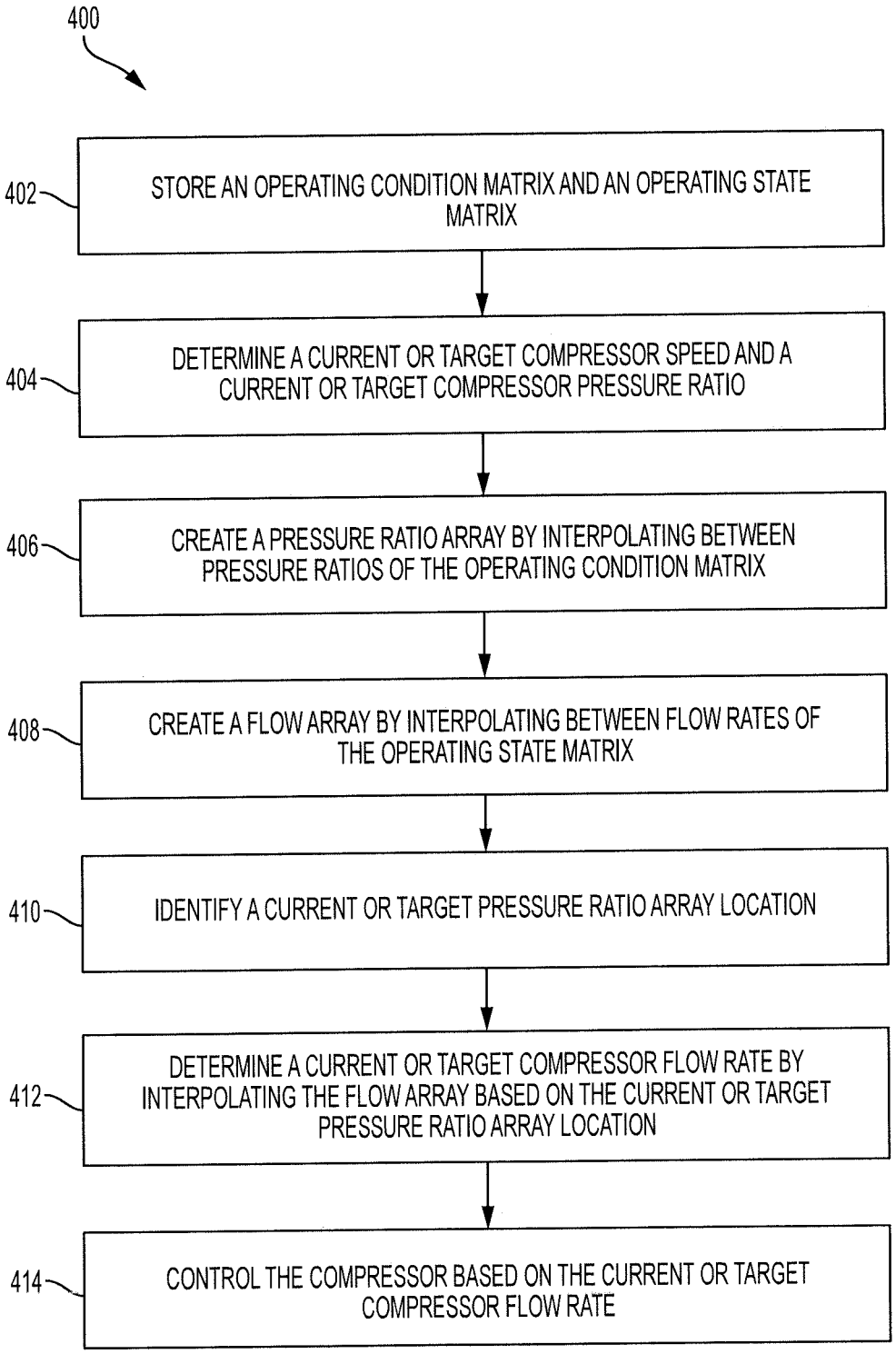
FIG. 4 is a flowchart illustrating a method for controlling a compressor using a real-time model of the compressor according to an embodiment of the present invention.

Turning now to FIG. 4, a method 400 for creating a real-time model of a compressor is shown. The method 400 may be performed, for example, by a model creation system such as the model creation system 302 of FIG. 3. The real-time model may be, for example, an interpolation of homotopic operating states (IHOS) model. In that regard, the model may be used by interpolating between various homotopic operating states of the compressor (i.e., between coupled states of compressor speed, compressor flow rate, and compressor pressure ratio).

Figure 5:
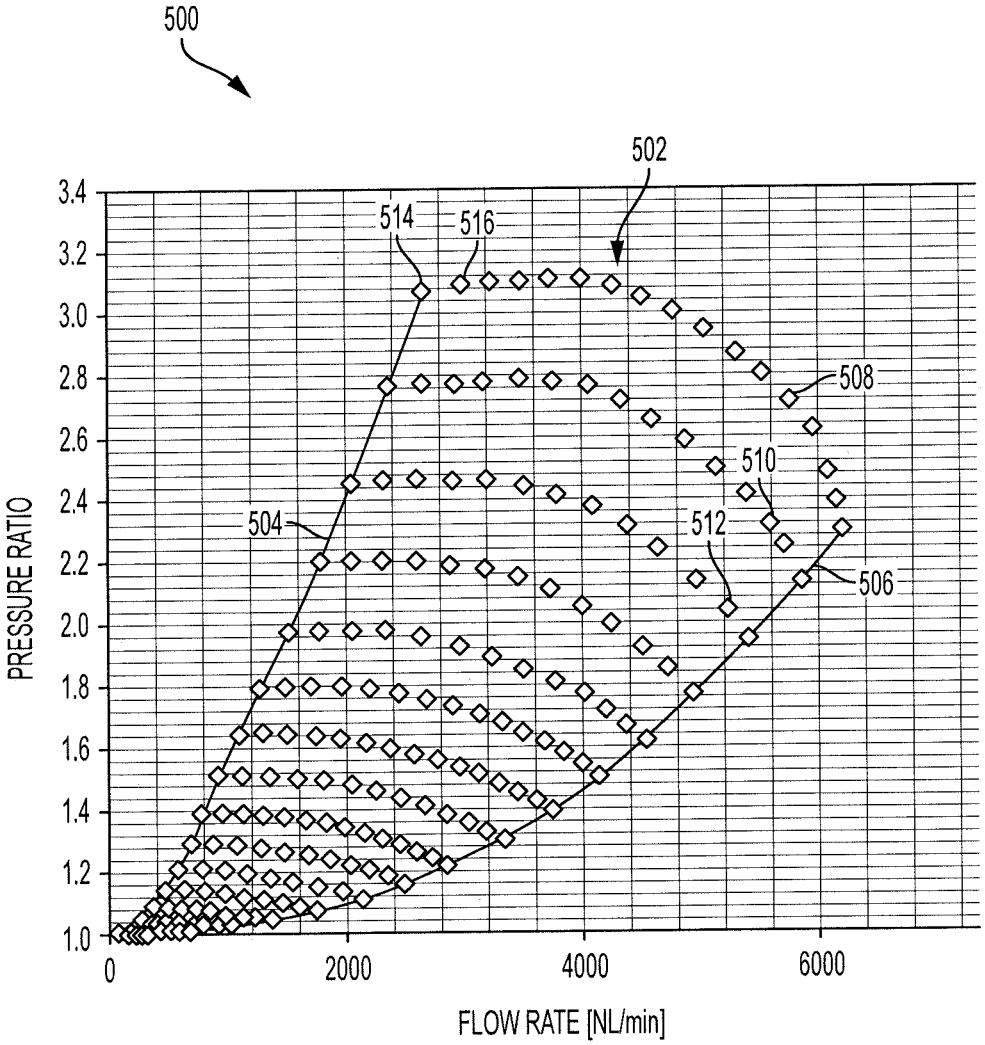
FIG. 5 is a speed map illustrating various operating states of a compressor according to an embodiment of the present invention.

The compressor flow rate, compressor pressure ratio, and compressor speed may be homotopic operating states of the compressor. Referring to FIG. 5, a speed map 500 illustrating various coupled states of a compressor is shown. The speed map 500 plots compressor flow rate along the X axis, compressor pressure ratio along the Y axis, and includes multiple speed lines 502 that indicate various compressor speeds. The states of the compressor are bound between a surge line 504 and a stall line 506. The various states are homotopic because they may linearly deform therebetween. For example, a first speed line 508 may linearly deform towards a second speed line 510.

Returning reference to FIG. 4, a compressor controller may store an operating condition matrix and an operating state matrix in a memory. The operating condition matrix and the operating state matrix may be based on the states of the compressor illustrated in the speed map 500.

Figure 6A:
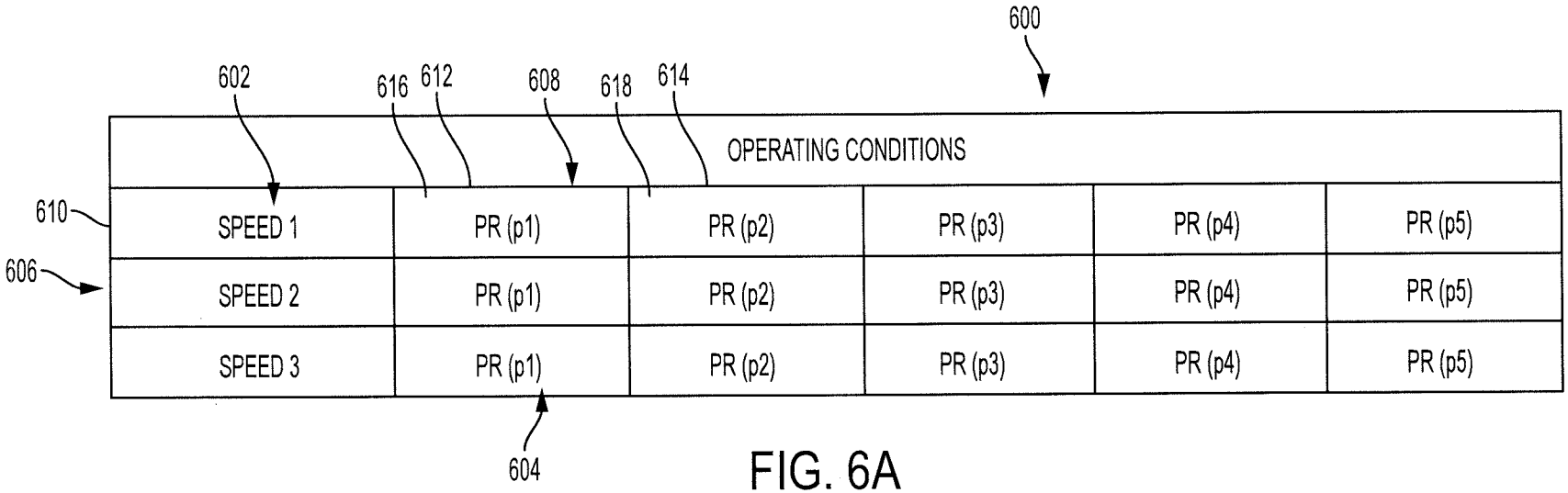
FIGS. 6A and 6B illustrate an exemplary operating condition matrix and an exemplary operating state matrix, respectively, as part of a real-time model of a compressor according to an embodiment of the present invention.
Figure 6B:
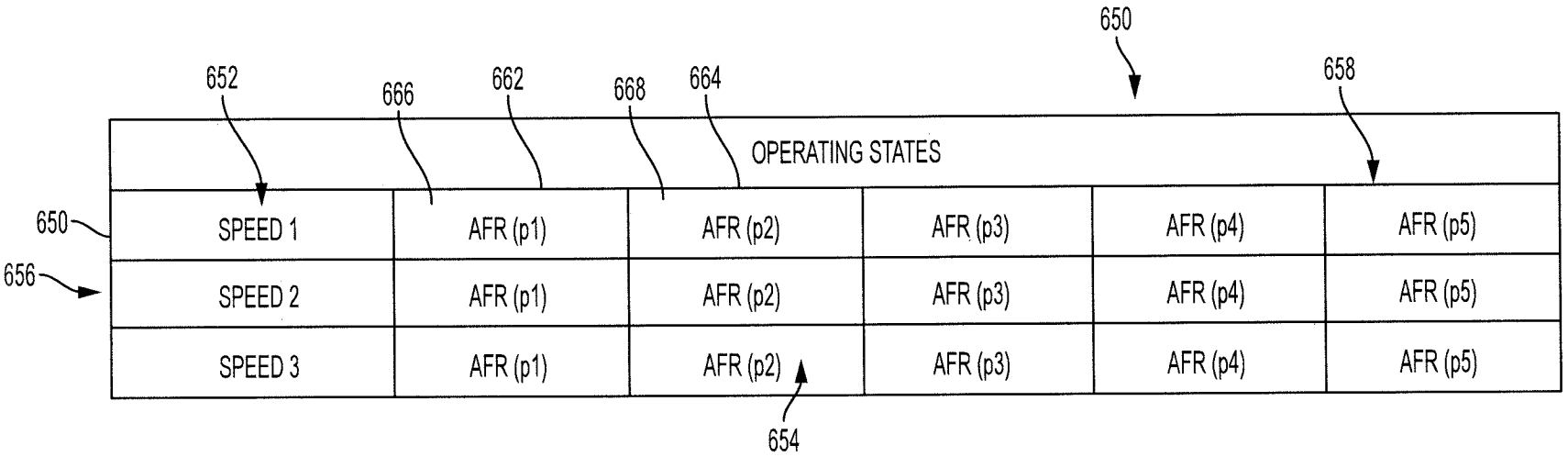

Referring to FIGS. 5, 6A, and 6B, an operating condition matrix 600 and an operating state matrix 650 are shown. The operating condition matrix 600 plots compressor speeds 602 against compressor pressure ratios 604. In particular, the operating condition matrix 600 includes a plurality of rows 606 each corresponding to one of a plurality of compressor speeds, and a plurality of columns 608 each corresponding to equally spaced locations between the surge line 504 and the stall line 506. For example, a first row 610 may correspond to speed 1, which corresponds to the speed line 508. A first column 612 may correspond to a first location 514, and a second column 614 may correspond to a second location 516. In that regard, a pressure ratio at a second location 616 may correspond to the pressure ratio at the first location 514, and a pressure ratio 618 may correspond to the pressure ratio at the second location 516.

The operating state matrix 650 may be similarly oriented and may plot compressor speeds 652 against compressor flow rates 654. In particular, the operating state matrix 650 includes a plurality of rows 656 each corresponding to one of a plurality of compressor speeds, and a plurality of columns 658 each corresponding to equally spaced locations between the surge line 504 and the stall line 506. For example, a first row 650 may correspond to speed 1, which corresponds to the speed line 508 (which corresponds to the same compressor speed as the first row 610 of the operating condition matrix 600). A first column 662 may correspond to the first location 514, and a second column 664 may correspond to a second location 516. In that regard, a compressor flow rate 666 may correspond to the compressor flow rate at the first location 514, and a compressor flow rate 668 may correspond to the compressor flow rate at the second location 516.

A quantity of columns of the operating condition matrix 600 may be equal to a quantity of columns in the operating state matrix 650. Furthermore, the cells of the operating condition matrix 600 may correspond to the cells of the operating state matrix 650. In that regard, when the compressor experiences the first speed corresponding to the first row 610 and the second pressure ratio 618, examination of the operating condition matrix 600 and the operating state matrix 650 indicates that the compressor will likewise experience the second airflow rate 668. This is because each cell of the operating state matrix 650 corresponds to an equally positioned cell in the operating condition matrix 600.

Returning reference to FIG. 4 and in block 404, the compressor controller may determine or receive a current or target compressor speed and a current or target compressor pressure ratio. For example, when the compressor controller is an ECU, the compressor controller may identify or determine the target compressor speed and the target compressor pressure ratio based on a current request of a fuel cell stack.

In block 406, the compressor controller may create a pressure ratio array by interpolating between pressure ratios of the operating condition matrix. For example, the compressor controller may create a pressure ratio array by interpolating between two lines of the operating condition matrix based on the current or target compressor speed.

Figure 7A:
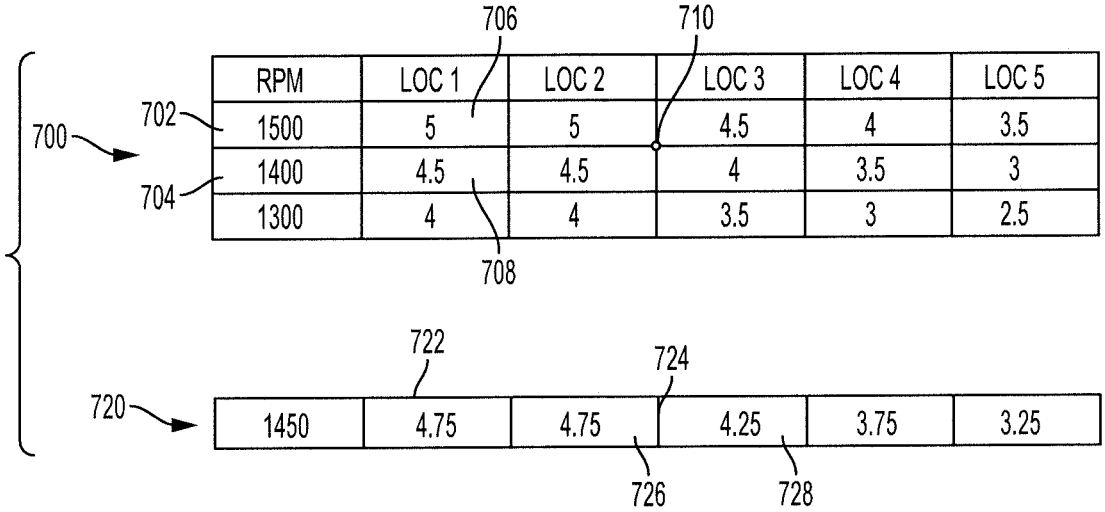
FIGS. 7A and 7B illustrate another exemplary operating condition matrix and exemplary operating state matrix, respectively, along with a pressure ratio array and a flow array to illustrate exemplary use of a real-time model to control a compressor according to an embodiment of the present invention.

For example and referring to FIG. 7A, an operating condition matrix 700 is shown. The compressor controller may receive a target compressor speed of 1450 rotations per minute (RPM). This compressor speed lies directly between a first row 702 corresponding to 1,500 RPM and a second row 704 corresponding to 1,400 RPM.

FIG. 7A further illustrates a pressure ratio array 720. As shown, the pressure ratio array 720 corresponds to the target compressor speed of 1,450 RPM. In order to create the pressure ratio array 720, the compressor controller may interpolate between the pressure ratio values of the first row 702 and the second row 704 for each of the locations. For example, a first location 722 of the pressure ratio array 720 is interpolated between a first location 706 of the first row 702 (corresponding to a pressure ratio of 5) and a first location 708 of the second row 704 (corresponding to a pressure ratio of 4.5). As shown, the value in a first location 722 of the pressure ratio array 720 is the average of 5 and 4.5, because the speed of 1,450 RPM is directly between the speed of 1,400 RPM and 1,500 RPM.

Returning reference to FIG. 4 and in block 408, the compressor controller may create a flow array by interpolating between flow rates of the operating state matrix. For example, the compressor controller may create a flow array by interpolating between two lines of the operating state matrix based on the current or target compressor speed.

Figure 7B:
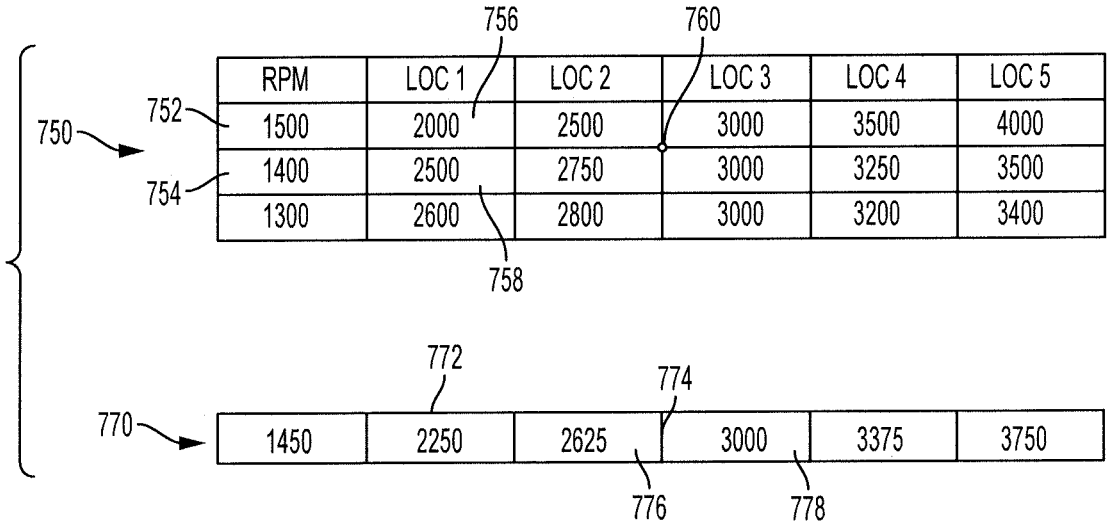

For example and referring to FIG. 7B, an operating state matrix 750 is shown. The compressor controller may receive a target compressor speed of 1,450 RPM. This compressor speed lies directly between a first row 752 corresponding to 1,500 rpm and a second row 754 corresponding to 1,400 RPM.

FIG. 7B further illustrates a flow array 770. As shown, the flow array 770 corresponds to the target compressor speed of 1,450 RPM. In order to create the flow array 770, the compressor controller may interpolate between the compressor flow rates of the first row 752 and the second row 754 for each of the locations. For example, a first location 772 of the flow array 770 is interpolated between a first location 756 of the first row 752 (corresponding to a flow rate of 2,000 Newton-liters per minute (NL/min)) and a first location 758 of the second row 754 (corresponding to a flow rate of 2,500 NL/min). As shown, the value in a first location 772 of the flow array 770 is the average of 2,000 and 2,500 NL/min.

Returning reference to FIG. 4 and in block 410, the compressor controller may identify a current or target pressure ratio array location. The current or target pressure ratio array location may be based on the current or target pressure ratio that was determined in block 404.

Returning reference to FIG. 7A, the target pressure ratio may be 4.5. Thus, the compressor controller may identify the current or target pressure ratio array location as a location 724 that is between the pressure ratio values of 4.75 and 4.25.

Returning reference to FIG. 4 and in block 412, the compressor controller may determine a current or target compressor flow rate by interpolating the flow array based on the current or target pressure ratio array location.

For example and returning reference to FIGS. 7A and 7B, the locations within the operating condition matrix 700 (and thus locations within the pressure ratio array 720) correspond to the same locations within the operating state matrix 750 (and thus locations within the flow array 770). Thus, a location 774 of the flow array 770 corresponds to the same location 724 in the pressure ratio array 720. The compressor controller may determine the corresponding compressor flow rate by interpolating between the cells 776 and 778 between which the location 774 is located. Thus, because the location 724 in the pressure ratio array 720 is evenly split between cells 726 and 728, the compressor controller may determine the target compressor flow rate by taking an average of the values in the cells 776 and 778 of the flow array 770. Accordingly, the compressor controller may determine the target compressor flow rate to be 2,812.5 NL/min.

The above example provides one manner of determining a current or target compressor flow rate by interpolating values in the operating condition matrix and in the operating state matrix. In some embodiments, the compressor controller may interpolate values in the operating condition matrix and the operating state matrix directly without creating a pressure ratio array and a flow array. For example, the location 724 within the pressure ratio array 720 also corresponds to a location 710 in the operating condition matrix. Based on this information, the compressor controller may determine the current or target compressor flow rate by interpolating between values at a corresponding location 760 of the operating state matrix.

Returning reference to FIG. 4 and in block 414, the compressor controller may control the compressor based on the current or target compressor flow rate. For example, the compressor controller may control the compressor to have the determined target compressor flow rate.

Figure 8:
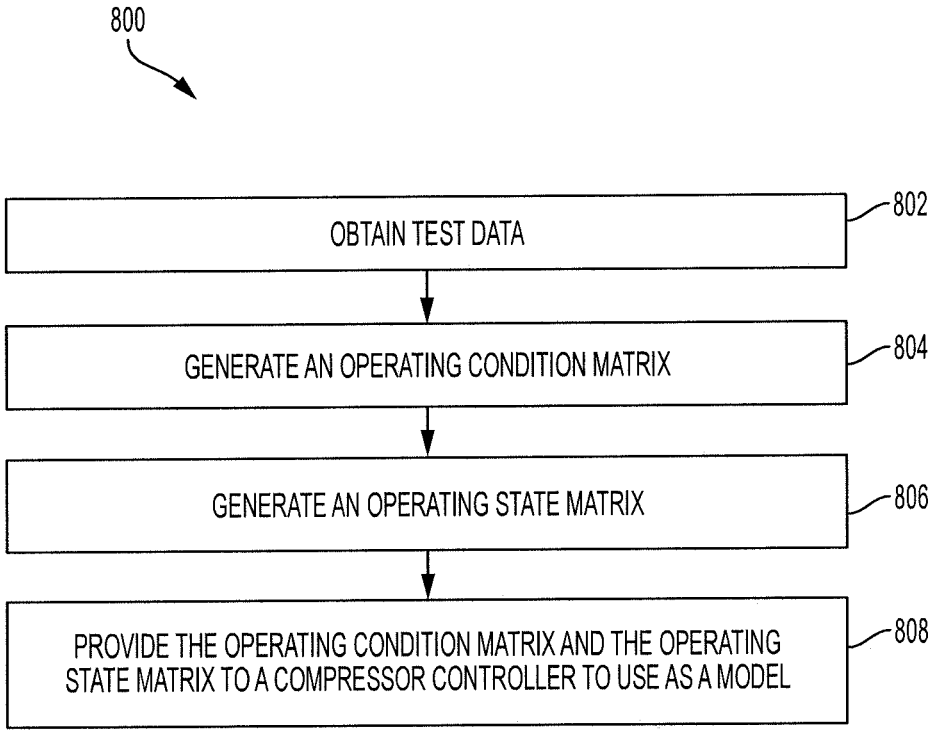
FIG. 8 is a flowchart illustrating a method for creating a real-time model of a compressor according to an embodiment of the present invention.

Turning now to FIG. 8, a method 800 for creating a real-time model of a compressor is shown. The real-time model may include an operating condition matrix and an operating state matrix, and a method similar to the method 400 of FIG. 4 may be used to control a physical compressor based on the model. The method 800 may be performed, for example, by a model creation system such as the model creation system 302 of FIG. 3.

Figure 9:
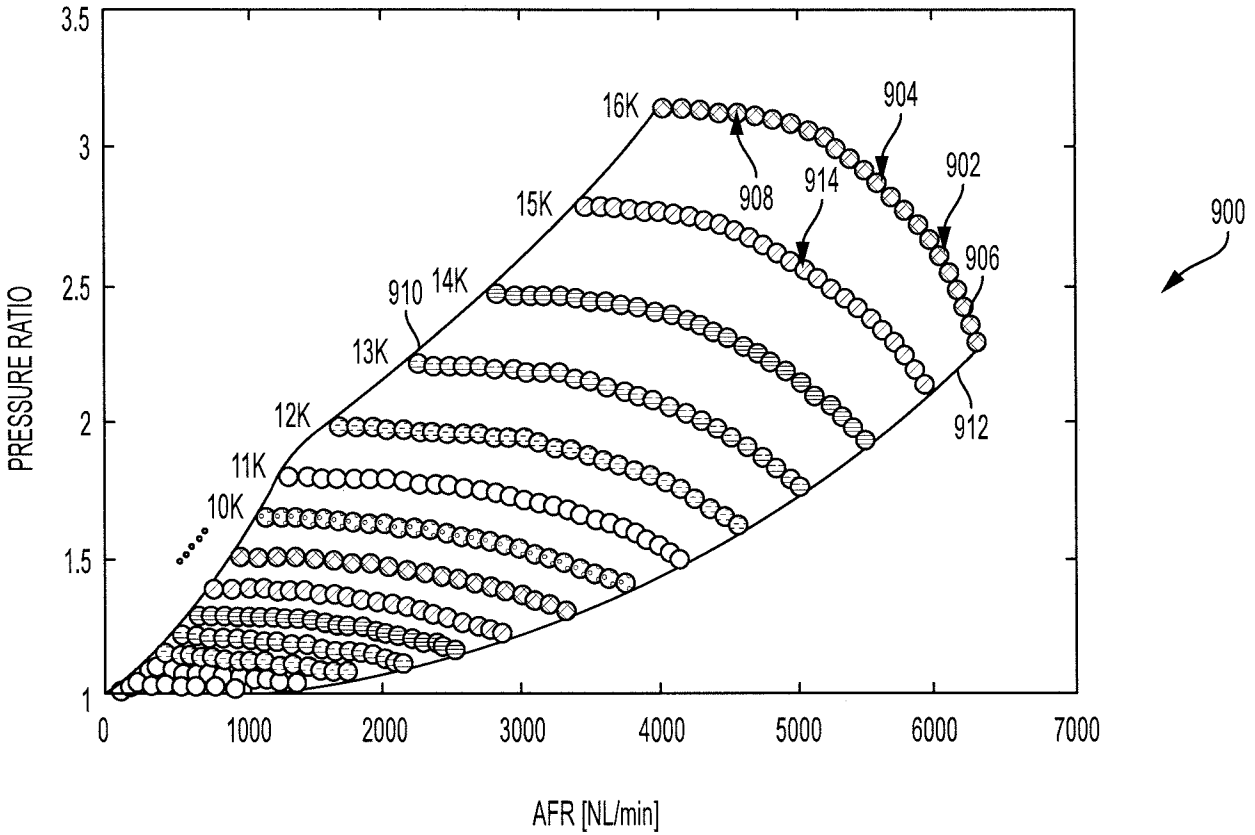
FIG. 9 is a speed map illustrating an exemplary test data usable to create a real-time model of a compressor including an operating condition matrix and an operating state matrix according to an embodiment of the present invention.

In block 802, a model controller may receive test data corresponding to operation of a compressor. For example, the test data may be obtained by performing testing using a physical compressor or using a non-real-time model of a physical compressor. Referring briefly to FIG. 9, a plot 900 illustrates collected test data 902 represented as multiple data points. The test data 902 may be obtained, for example, by holding one of the states (such as compressor speed) at a steady value and varying the other states (such as the compressor flow rate and the compressor pressure ratio). For example, a tester or the model controller may set the compressor to have a speed of 16,000 RPM and may adjust the compressor pressure ratio and compressor flow rate to obtain at multiple test points 904 along a speed line 906 that corresponds to 16,000 RPM. After collecting these data points, the tester or the model controller may set the compressor to have another speed and may adjust the compressor pressure ratio and compressor flow rate to obtain multiple test points along a new speed line that corresponds to the new compressor speed.

Returning reference to FIG. 8 and in block 804, the model controller may generate an operating condition matrix using the test data that was obtained in block 802. For example, the operating condition matrix may be similar to the operating condition matrix 700 of FIG. 7A. As described above, it is desirable for the operating condition matrix to include compressor pressure ratio values that are equally spaced between a surge line and a stall line for each of the compressor speeds.

Referring now to FIGS. 7A and 9, a model controller may create the operating condition matrix 700 using the test data 902 in various manners. For example, the model controller may interpolate the pressure ratio values between points of the test data 902. The model controller may first select a set of equally spaced points 908 between a surge line 910 and a stall line 912. The model controller may then interpolate the pressure ratio values at each of the equally spaced points 908 based on the detected test data 902.

As another example, the model controller may create a set of lines 914 based on the points of the test data 902, and then may calculate the compressor ratio values along the set of lines. In that regard, the model controller may create the operating condition matrix using a line fitting technique.

Returning reference to FIG. 8 and in block 806, the model controller may generate an operating state matrix. The operating state matrix may be created in a similar manner as the operating condition matrix. For example and returning reference to FIG. 9, the model controller may calculate compressor flow rates for each of the equally spaced points 908 between these surge line at 910 and the stall line 912.

Returning reference to FIG. 8 and in block 808, the model controller may provide the operating condition matrix and the operating state matrix to a compressor controller to use as a real-time model of the compressor. The combination of the operating condition matrix and the operating state matrix may be referred to as a real-time model because the compressor controller can use the operating condition matrix and the operating state matrix to control a compressor in real-time using a method similar to the method 400 of FIG. 4. For example, the model controller may provide the operating condition matrix and the operating state matrix to the compressor controller via an input/output port or any other known data transmission technique. In various embodiments, a user may transport the real-time model from the model controller to the compressor controller, for example, by storing the real-time model on a removable memory device from the model controller, and transferring the real-time model from the removable memory device to the compressor controller.

Where used throughout the specification and the claims, "at least one of A or B" includes "A" only, "B" only, or "A and B." Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A system for real-time controller modeling, comprising:

a compressor having an inlet and an outlet and configured to operate at a compressor speed, a compressor flow rate corresponding to a flow of fluid through the compressor, and a compressor pressure ratio corresponding to a ratio of an inlet pressure at the inlet to an outlet pressure at the outlet;

a memory configured to store an operating condition matrix that plots multiple compressor pressure ratios to each of a plurality of compressor speeds, and an operating state matrix that plots multiple compressor flow rates to each of the plurality of compressor speeds, the operating condition matrix being related to the operating state matrix such that a first compressor pressure ratio at a first location of the operating condition matrix corresponds to a first compressor flow rate at a corresponding location of the operating state matrix; and a compressor controller coupled to the compressor and the memory and configured to:

determine a current or target compressor speed and a current or target compressor pressure ratio, create a pressure ratio array by interpolating between the multiple compressor pressure ratios corresponding to two of the plurality of compressor speeds based on the current or target compressor speed, identify a current or target pressure ratio array location using the pressure ratio array, identify a current or target location in the operating condition matrix based on the current or target pressure ratio array location, identify the current or target pressure ratio array location by identifying two of the multiple compressor pressure ratios of the pressure ratio array that are nearest to the current or target compressor pressure ratio and identifying a distance from the current or target compressor pressure ratio to at least one of the two of the multiple compressor pressure ratios, determine a current or target compressor flow rate by interpolating values in the operating state matrix based on the current or target location, and control the compressor based on the current or target compressor flow rate.

2. The system of claim 1 wherein the compressor controller is further configured to: create a flow array by interpolating between the multiple compressor flow rates corresponding to the two of the plurality of compressor speeds based on the current or target compressor speed; and determine the current or target compressor flow rate by interpolating between two of the multiple compressor flow rates based on the current or target pressure ratio array location.

3. The system of claim 1 wherein:

the compressor is configured to operate between a stall line beyond which the compressor operates in a stall condition, and a surge line beyond which the compressor operates in a surge condition; and the operating condition matrix includes a first plurality of rows each corresponding to one of the plurality of compressor speeds, and a first plurality of columns each corresponding to equally spaced locations along the plurality of compressor speeds between the stall line and the surge line, each cell of the operating condition matrix including a pressure ratio value.

4. The system of claim 3 wherein the operating state matrix includes a second plurality of rows each corresponding to the one of the plurality of compressor speeds of the operating condition matrix, and a second plurality of columns each corresponding to the equally spaced locations along the plurality of compressor speeds between the stall line and the surge line, a first quantity of the first plurality of columns being equal to a second quantity of the second plurality of columns.

5. The system of claim 1 further comprising a fuel cell stack configured to facilitate a chemical reaction between air and hydrogen to generate electricity, wherein:

the fuel cell stack and the compressor are configured for use in a vehicle;

the compressor is configured to pump the air to the fuel cell stack; and the compressor controller is an electronic control unit (ECU) of the vehicle.

6. The system of claim 1 wherein the compressor speed, the compressor flow rate, and the compressor pressure ratio are homotopic operating states.

7. A method for real-time modeling of a compressor that is designed to operate between a stall line beyond which the compressor operates in a stall condition, and a surge line beyond which the compressor operates in a surge condition, the method comprising:

storing, in a memory, an operating condition matrix that plots multiple compressor pressure ratios to each of a plurality of compressor speeds;

storing, in the memory, an operating state matrix that plots multiple compressor flow rates to each of the plurality of compressor speeds, the operating condition matrix being related to the operating state matrix such that a first compressor pressure ratio at a first location of the operating condition matrix corresponds to a first compressor flow rate at a corresponding location of the operating state matrix, the operating condition matrix including a first plurality of rows each corresponding to one of the plurality of compressor speeds and a first plurality of columns each corresponding to equally spaced locations along the plurality of compressor speeds between the stall line and the surge line, each cell of the operating condition matrix including a pressure ratio value;

determining, by a compressor controller, a current or target compressor speed and a current or target compressor pressure ratio;

identifying, by the compressor controller, a current or target location in the operating condition matrix based on the current or target compressor speed and the current or target compressor pressure ratio;

determining, by the compressor controller, a current or target compressor flow rate by interpolating values in the operating state matrix based on the current or target location; and controlling, by the compressor controller, the compressor based on the current or target compressor flow rate.

8. The method of claim 7 further comprising:

creating, by the compressor controller, a pressure ratio array by interpolating between the multiple compressor pressure ratios corresponding to two of the plurality of compressor speeds based on the current or target compressor speed;

identifying, by the compressor controller, a current or target pressure ratio array location by identifying two of the multiple compressor pressure ratios of the pressure ratio array that are nearest to the current or target compressor pressure ratio and identifying a distance from the current or target compressor pressure ratio to at least one of the two of the multiple compressor pressure ratios; and identifying, by the compressor controller, the current or target location in the operating condition matrix based on the current or target pressure ratio array location.

9. The method of claim 8 further comprising:

creating, by the compressor controller, a flow array by interpolating between the multiple compressor flow rates corresponding to the two of the plurality of compressor speeds based on the current or target compressor speed; and determining, by the compressor controller, the current or target compressor flow rate by interpolating between two of the multiple compressor flow rates based on the current or target pressure ratio array location.

10. The method of claim 7 wherein the operating state matrix includes a second plurality of rows each corresponding to the one of the plurality of compressor speeds of the operating condition matrix, and a second plurality of columns each corresponding to the equally spaced locations along the plurality of compressor speeds between the stall line and the surge line, a first quantity of the first plurality of columns being equal to a second quantity of the second plurality of columns.

11. The method of claim 7 wherein controlling the compressor includes controlling the compressor to pump air to a fuel cell stack of a vehicle, and wherein the compressor controller is an electronic control unit (ECU) of the vehicle.

12. The method of claim 7 wherein a compressor speed, a compressor flow rate, and a compressor pressure ratio are homotopic operating states.

13. A method for real-time modeling of a compressor comprising:

obtaining, by a model controller, test data including combinations of compressor speeds, compressor pressure ratios, and compressor flow rates, the test data being obtained by at least one of detecting the test data from a physical compressor or calculating the test data using a model of the compressor;

generating, by the model controller, an operating condition matrix that plots multiple compressor pressure ratios to each of a plurality of compressor speeds based on the test data;

generating, by the model controller, an operating state matrix that plots multiple compressor flow rates to each of the plurality of compressor speeds based on the test data;

providing the operating condition matrix and the operating state matrix to a compressor controller as a model of the compressor such that the compressor controller can control the compressor based on the model; and generating the operating condition matrix includes generating the operating condition matrix to include multiple equally-spaced compressor pressure ratio values for multiple compressor speeds, and generating the operating state matrix includes generating the operating state matrix to include multiple equally-spaced compressor flow rates for each of the multiple compressor speeds.

14. The method of claim 13 wherein generating the operating condition matrix includes at least one of interpolating the multiple equally-spaced compressor pressure ratio values between points of the test data, or creating a set of lines based on the points of the test data and calculating the multiple equally-spaced compressor pressure ratio values along the set of lines.

15. The method of claim 13 wherein the operating condition matrix is related to the operating state matrix such that a first compressor pressure ratio at a first location of the operating condition matrix corresponds to a first compressor flow rate at a corresponding location of the operating state matrix.

16. The method of claim 13 wherein the multiple compressor pressure ratios of the operating condition matrix are bound between a stall line of the compressor and a surge line of the compressor, and the multiple compressor flow rates of the operating state matrix are bound between the stall line and the surge line.

* * * * *